US009707771B2

(12) United States Patent
Ge et al.

(10) Patent No.: US 9,707,771 B2
(45) Date of Patent: Jul. 18, 2017

(54) FLUID EJECTION DEVICE WITH INTEGRATED INK LEVEL SENSORS

(71) Applicant: HEWLETT-PACKARD DEVELOPMENT COMPANY, L.P., Houston, TX (US)

(72) Inventors: Ning Ge, Palo Alto, CA (US); Patrick Leonard, Leixlip (IE)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/107,420

(22) PCT Filed: Jan. 3, 2014

(86) PCT No.: PCT/US2014/010202

§ 371 (c)(1),
(2) Date: Jun. 22, 2016

(87) PCT Pub. No.: WO2015/102639

PCT Pub. Date: Jul. 9, 2015

(65) Prior Publication Data

US 2017/0036452 A1 Feb. 9, 2017

(51) Int. Cl.

| | |
|---|---|
| ***B41J 2/175*** | (2006.01) |
| ***B41J 2/045*** | (2006.01) |
| ***B41J 2/14*** | (2006.01) |

(52) U.S. Cl.

CPC ..... *B41J 2/17566* (2013.01); *B41J 2/0458* (2013.01); *B41J 2/04541* (2013.01); *B41J 2/14153* (2013.01); *B41J 2002/14354* (2013.01)

(58) Field of Classification Search

CPC .. B41J 2/17566; B41J 2/04541; B41J 2/0458; B41J 2/14153

See application file for complete search history.

(56) References Cited

U.S. PATENT DOCUMENTS 5,721,574 A * 2/1998 Kubby ..... B41J 2/04541 347/7

6,398,329 B1 6/2002 Boyd et al.

(Continued)

FOREIGN PATENT DOCUMENTS

EP 1281524 A2 2/2003
TW 200911540 A 3/2009

(Continued)

OTHER PUBLICATIONS

Taiwan Excellence, Curable Inkjet Printer, 2012, http://www.taiwanexcellence.org/index.php/awards/nowdt/content/3/1/095306JA-G017.

*Primary Examiner* — Jason Uhlenhake

(74) *Attorney, Agent, or Firm* — HP Inc.—Patent Department

(57) ABSTRACT

In an embodiment, a fluid ejection device includes a fluid feed slot formed in a printhead die and a plurality of printhead-integrated ink level sensors (PILS). A fluid ejection device may include a first PILS to sense an ink level of a first chamber in fluid communication with the fluid feed slot, the first PILS to detect an empty ink level of the first chamber when the fluid ejection device is at a first ink level state, and a second PILS to sense an ink level of a second chamber in fluid communication with the fluid feed slot, the second PILS to detect an empty ink level of the second chamber when the fluid ejection device is at a second ink level state, different than the first ink level state.

15 Claims, 11 Drawing Sheets

(56) References Cited

U.S. PATENT DOCUMENTS

| | | | | |
|---|---|---|---|---|
| 6,648,434 | B2 | 11/2003 | Walker et al. | |
| 6,802,581 | B2 | 10/2004 | Hasseler et al. | |
| 2007/0153032 | A1 | 7/2007 | Chou et al. | |
| 2008/0231651 | A1 | 9/2008 | Jung | |
| 2010/0295884 | A1* | 11/2010 | Smektala ..... | B41J 2/17566 347/7 |

FOREIGN PATENT DOCUMENTS

| | | | |
|---|---|---|---|
| TW | 201313494 | A1 | 4/2013 |
| TW | 201332787 | A1 | 8/2013 |
| TW | 201343413 | A1 | 11/2013 |
| WO | WO-2010077387 | A1 | 7/2010 |
| WO | WO-2013-002762 | A1 | 1/2013 |

* cited by examiner

FLUID EJECTION DEVICE WITH INTEGRATED INK LEVEL SENSORS

BACKGROUND

Some printing systems may be endowed with devices for determining the level of a fluid, such as ink, in a reservoir or other fluidic chamber. For example, prisms may be used to reflect or refract light beams in ink cartridges to generate electrical and or user-viewable ink level indications. Some systems may use backpressure indicators to determine ink levels in a reservoir. Other printing systems may count the number of ink drops ejected from inkjet print cartridges as a way of determining ink levels. Still other systems may use the electrical conductivity of the ink as an ink level indicator in printing systems.

BRIEF DESCRIPTION OF THE DRAWINGS

The detailed description section references the drawings, wherein.

Figure 1:
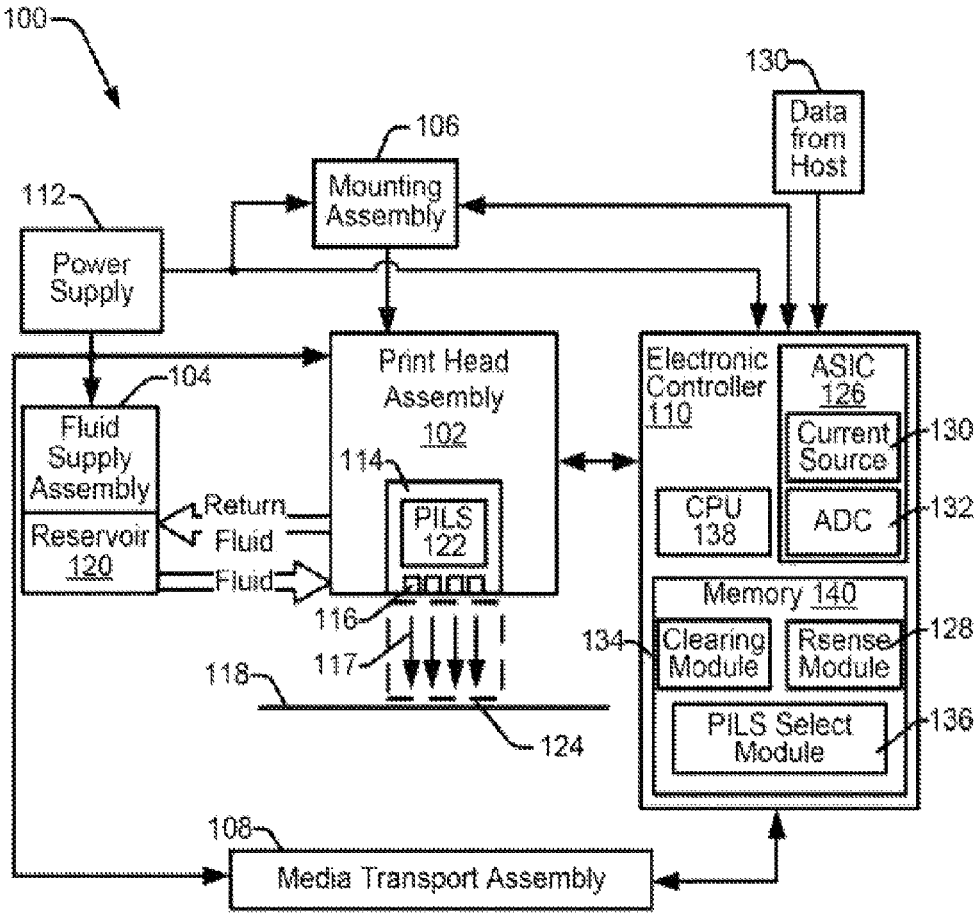
FIG. 1 is a block diagram of an example of a fluid ejection system suitable for incorporating printhead-integrated ink level sensors (PILS)

all in which various embodiments may be implemented.

Examples are shown in the drawings and described in detail below. The drawings are not necessarily to scale, and various features and views of the drawings may be shown exaggerated in scale or in schematic for clarity and/or conciseness. The same part numbers may designate the same or similar parts throughout the drawings.

DETAILED DESCRIPTION

As noted above, there are a number of techniques available for determining the level of a fluid, such as ink, in a reservoir or other fluidic chamber. Accurate ink level sensing in ink supply reservoirs for many types of inkjet printers may be desirable for a number of reasons. For example, sensing the correct level of ink and providing a corresponding indication of the amount of ink left in an ink cartridge allows printer users to prepare to replace finished ink cartridges. Accurate ink level indications also help to avoid wasting ink, since inaccurate ink level indications often result in the premature replacement of ink cartridges that still contain ink. In addition, printing systems can use ink level sensing to trigger certain actions that help prevent low quality prints that might result from inadequate supply levels.

Described herein are various implementations of printhead-integrated ink level sensor (PILS) and sensing techniques, and apparatuses and systems endowed with such PILS and/or sensing techniques. In various implementations, the PILS may be integrated on-board a thermal inkjet (TIJ) printhead die. The sense circuit may implement a sample and hold technique that captures the ink level state of the fluid ejection device through a capacitive sensor. The capacitance of the capacitive sensor may change with the level of ink. For each PILS, a charge placed on the capacitive sensor may be shared between the capacitive sensor and a reference capacitor, causing a reference voltage at the gate of an evaluation transistor. A current source in a printer application specific integrated circuit (ASIC) may supply current at the transistor drain. The ASIC may measure the resulting voltage at the current source and calculate the corresponding drain-to-source resistance of the evaluation transistor. The ASIC may then determine the ink level status of the fluid ejection device based on the resistance determined from the evaluation transistor.

In various implementations, accuracy may be improved through the use of multiple PILS integrated on a printhead die. For example, a fluid election device may include a first PILS to sense an ink level of a first chamber in fluid communication with the fluid feed slot, and a second PILS to sense an ink level of a second chamber in fluid communication with the fluid feed slot. The first PILS may detect an empty ink level of the first chamber when the fluid ejection device is at a first ink level state, while the second PILS may detect an empty ink level of the second chamber when the fluid ejection device is at a second ink level state, different than the first ink level state in various ones of these implementations, a plurality of ink level states may be determined based on the different states of the differently configured PILS, which may allow more defined ink level sensing. A shift register may serve as a selective circuit to address the multiple PILS and enable the ASIC to measure multiple voltages and determine the ink level status based on measurements taken at various locations on the printhead die. In various implementations, a chamber in fluid communication with a fluid feed slot of the fluid ejection device may include a clearing resistor circuit to clear the chamber of ink.

In various implementations, a processor-readable medium may store code representing instructions that when executed by a processor cause the processor to initiate operation of a first print head-integrated ink level sensor (PILS) of a first chamber in fluid communication with a fluid feed slot of the fluid ejection device and a second PILS of a second chamber in fluid communication with the fluid feed slot. A shift register may be controlled to multiplex outputs from the first PILS and the second PILS onto a common ID line. From the outputs, an ink level state of the fluid ejection device may be determined based on differing ink levels sensed by the first PILS and the second PILS.

In various implementations, a processor-readable medium may store code representing instructions that when executed by a processor cause the processor to activate a clearing resistor circuit to purge ink from a sense chamber, apply a pre-charge voltage Vp to a sense capacitor within the chamber to charge the sense capacitor with a charge Q1. The charge Q1 may be shared between the sense capacitor and a reference capacitor, causing a reference voltage Vg at the gate of an evaluation transistor. A resistance may be determined from drain to source of the evaluation transistor that results from Vg. In an implementation, a delay may be provided after activating the clearing resistor circuit to enable ink from a fluid slot to flow back into the sense chamber prior to applying the pre-charge voltage Vp.

Turning now to FIG. 1, illustrated is a block diagram of an example fluid ejection system 100 suitable for incorporating a fluid ejection device comprising printhead-integrated ink level sensors (PILS) as disclosed herein. In various implementations, the fluid ejection system 100 may comprise an inkjet printer or printing system. The fluid ejection system 100 may include a printhead assembly 102, a fluid supply assembly 104, a mounting assembly 106, a media transport assembly 108, an electronic controller 110, and at least one power apply 112 that may provide power to the various electrical components of fluid ejection system 100.

The printhead assembly 102 may include at least one printhead 114. The printhead 114 may comprise a printhead die having a fluid feed slot along a length of a printhead die to supply a fluid, such as ink, for example, to a plurality of drop ejectors 116, such as orifices or nozzles, for example. The plurality of drop ejectors 116 may eject ejects drops of the fluid toward a print media 118 so as to print onto the print media 118. The print media 118 may be any type of suitable sheet or roll material, such as, for example, paper, card stock, transparencies, polyester, plywood, foam board, fabric, canvas, and the like. The drop ejectors 116 may be arranged in one or more columns or arrays such that properly sequenced ejection of fluid from drop ejectors 116 may cause characters, symbols, and/or other graphics or images to be printed on the print media 118 as the print head assembly 102 and print media 118 are moved relative to each other.

The fluid supply assembly 104 may supply fluid to the printhead assembly 102 and may include a reservoir 120 for storing the fluid. In general, fluid may flow from the reservoir 120 to the printhead assembly 102, and the fluid supply assembly 104 and the printhead assembly 102 may form a one-way fluid delivery system or a recirculating fluid delivery system. In a one-way fluid delivery system, substantially all of the fluid supplied to the printhead assembly 102 may be consumed during printing. In a recirculating fluid delivery system, however, only a portion of the fluid supplied to the printhead assembly 102 may be consumed during printing. Fluid not consumed during printing may be returned to the fluid supply assembly 104. The reservoir 120 of the fluid supply assembly 104 may be removed, replaced, and or refilled.

The mounting assembly 106 may position the printhead assembly 102 relative to the media transport assembly 108, and the media transport assembly 108 may position the print media 118 relative to the printhead assembly 102. In this configuration, a print zone 124 may be defined adjacent to the drop ejectors 116 in an area between the printhead assembly 102 and print media 118. In some implementations, the printhead assembly 102 is a scanning type printhead assembly. As such, the mounting assembly 106 may include a carriage for moving the printhead assembly 102 relative to the media transport assembly 108 to scan the print media 118. In other implementations, the printhead assembly 102 is a non-scanning type printhead assembly. As such, the mounting assembly 106 may fix the printhead assembly 102 at a prescribed position relative to the media transport assembly 108. Thus, the media transport assembly 108 my position the print media 118 relative to the printhead assembly 102.

The electronic controller 110 may include a processor (CPU) 138, memory 140, firmware, software, and other electronics for communicating with and controlling the printhead assembly 102, mounting assembly 106, and media transport assembly 108. Memory 140 may include both volatile (e.g., RAM) and nonvolatile (e.g., ROM, hard disk, floppy disk, CD-ROM, etc.) memory components comprising computer/processor-readable media that provide for the storage of computer processor-executable coded instructions, data structures, program modules, and other data for the printing system 100. The electronic controller 110 may receive data 130 from a host system, such as a computer, and temporarily store the data 130 in memory 140. Typically, the data 130 may be sent to the printing system 100 along an electronic infrared, optical, or other information transfer path. The data 130 may represent, for example, a document and or file to be printed. As such, the data 130 may form a print job for the printing system 100 and may include one or more print job commands and/or command parameters.

In various implementations, the electronic controller 110 may control the printhead assembly 102 for ejection of fluid drops 117 from the drop ejectors 116. Thus, the electronic controller 110 may define a pattern of elected fluid drops 117 that form characters, symbols, and/or other graphics or images on the print media 118. The pattern of ejected fluid drops 117 may be determined by the print job commands and/or command parameters from the data 130.

In various implementations, the electronic controller 110 may include a printer application specific integrated circuit (ASIC) 126 to determine the level of ink in the fluid ejection device/printhead 114 based on resistance values from one or more printhead-integrated ink level sensors (PILS) 122. The printer ASIC 126 may include a current source 130 and an analog-to-digital converter (ADC) 132. The ASIC 126 may converge the voltage present at current source 130 to determine a resistance, and then determine a corresponding digital resistance value through the ADC 132. A programmable algorithm implemented through executable instructions within a resistance-sense module 128 in memory 140 may enable the resistance determination and the subsequent digital conversion through the ADC 132. In various implementations, the memory 140 of electronic controller 110 may include a programmable algorithm implemented through executable instructions within an ink clearing module 134 that comprises instructions executable by the processor 138 of the controller 110 to activate a clearing resistor circuit on the integrated printhead 114 to purge ink and or ink residue out of a PILS chamber. In another implementation, where the printhead 114 comprises multiple PILS, the memory 140 of the electronic controller 110 may include a programmable algorithm implemented through executable instructions within a PILS select module 136 executable by the processor 138 of the controller 110 to control a shift register for selecting individual PILS to be used to sense ink levels to determine an ink level state of the fluid ejection device.

In various implementations, the printing system 100 is a drop-on-demand thermal inkjet printing system with a thermal inkjet (TIJ) printhead 114 suitable for implementing a printhead die 114 having a plurality of PILS 122 as described herein. In some implementations, the printhead assembly 102 may include a single TIJ printhead 114. In other implementations, the printhead assembly 102 may include a wide array of TIJ printheads 114. While the fabrication processes associated with TIJ printheads are well suited to the integration of the printhead dies described herein, other printhead types such as a piezoelectric printhead can also implement a printhead die 114 having a plurality of PILS 122.

Figure 2:
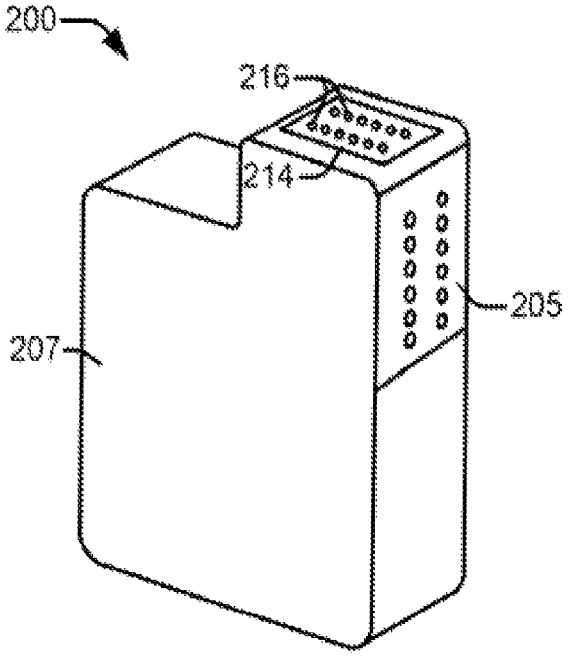
FIG. 2 is a perspective view of an example fluid ejection cartridge suitable for incorporating PILS.

In various implementations, the printhead assembly 102, fluid supply assembly 104, and reservoir 120 may be housed together in a replaceable device such as an integrated printhead cartridge. FIG. 2 is a perspective view of an example inkjet cartridge 200 that may include the printhead assembly 102, ink supply assembly 104, and reservoir 120, according to an implementation of the disclosure.

In addition to one or more printheads 114, inkjet cartridge 200 may include electrical contacts 205 and an ink (or other fluid) supply chamber 207. In some implementations, the cartridge 200 may have a supply chamber 207 that stores one color of ink, and in other implementations it may have a number of chambers 207 that each store a different color of ink. The electrical contacts 205 may carry electrical signals to and from a controller (such as, e.g., the electrical controller 110 described herein with reference to FIG. 1) and power (from the power supply 112 described herein with reference to FIG. 1) to cause the ejection of ink drops through the drop ejectors 216 and make ink level measurements.

Figure 3:
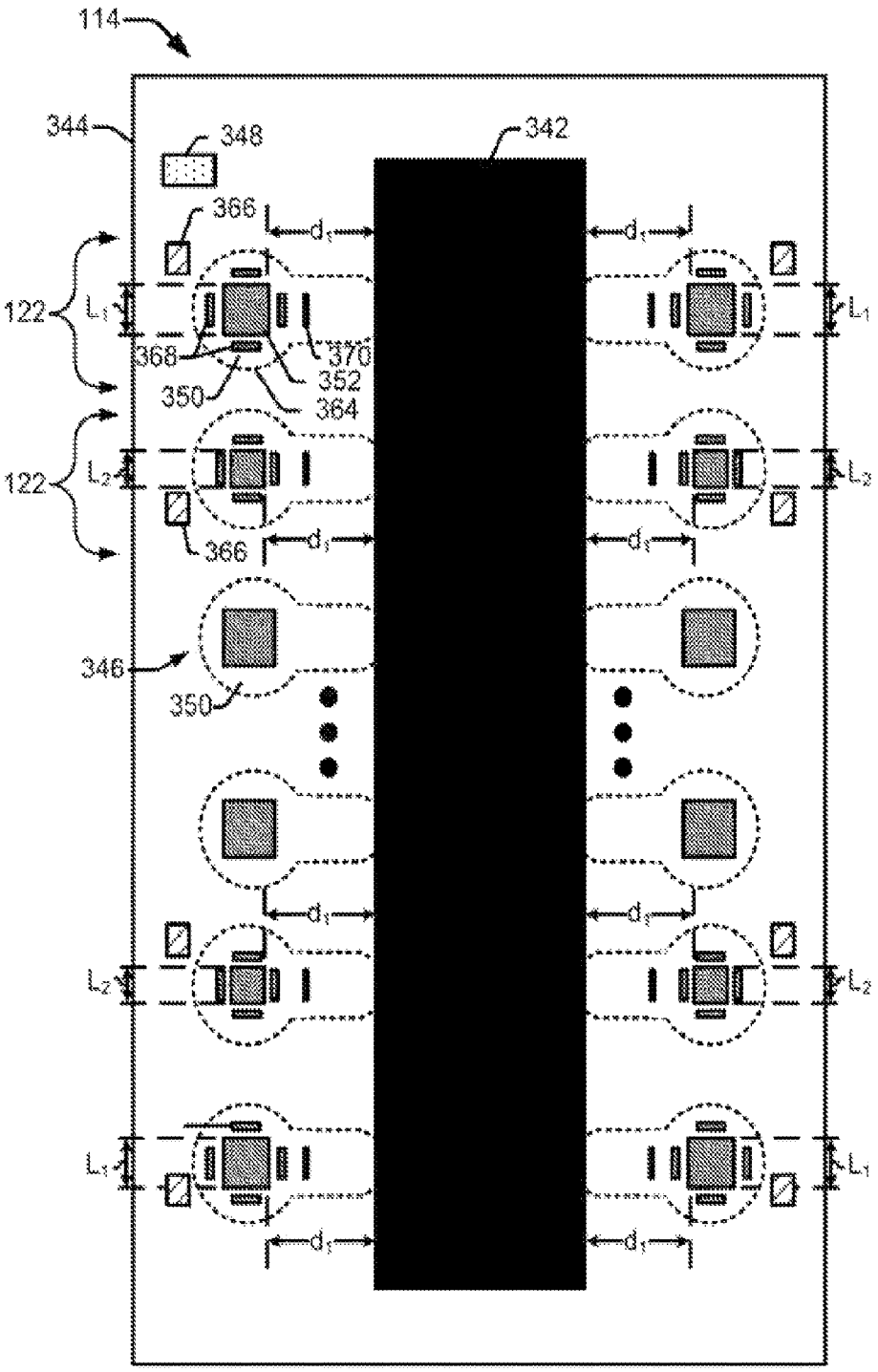
FIG. 3 is a bottom view of a printhead including a fluid feed slot and PILS.
Figure 4:
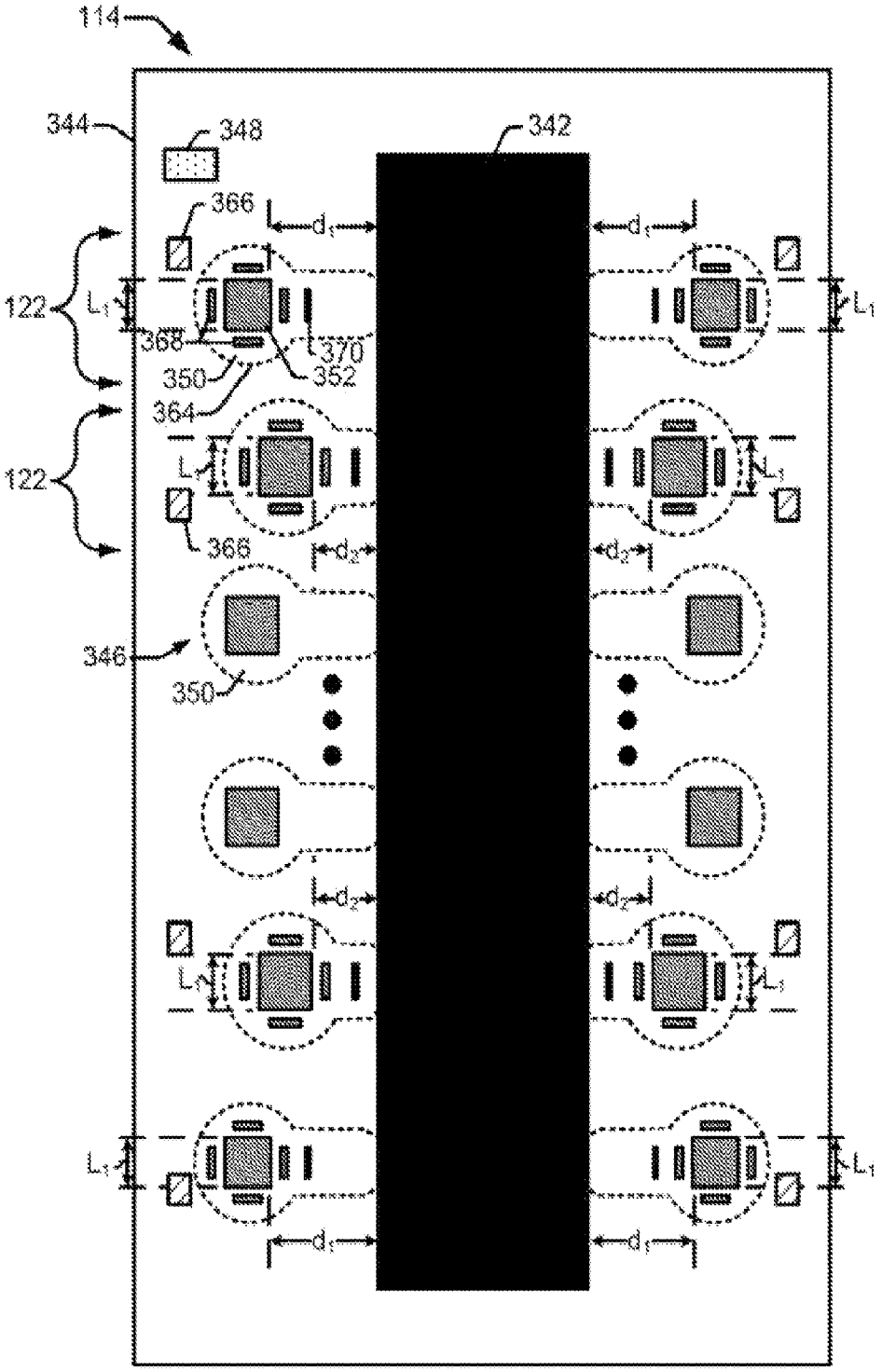
FIG. 4 is a bottom view of another printhead including a fluid feed slot and PILS.
Figure 5:
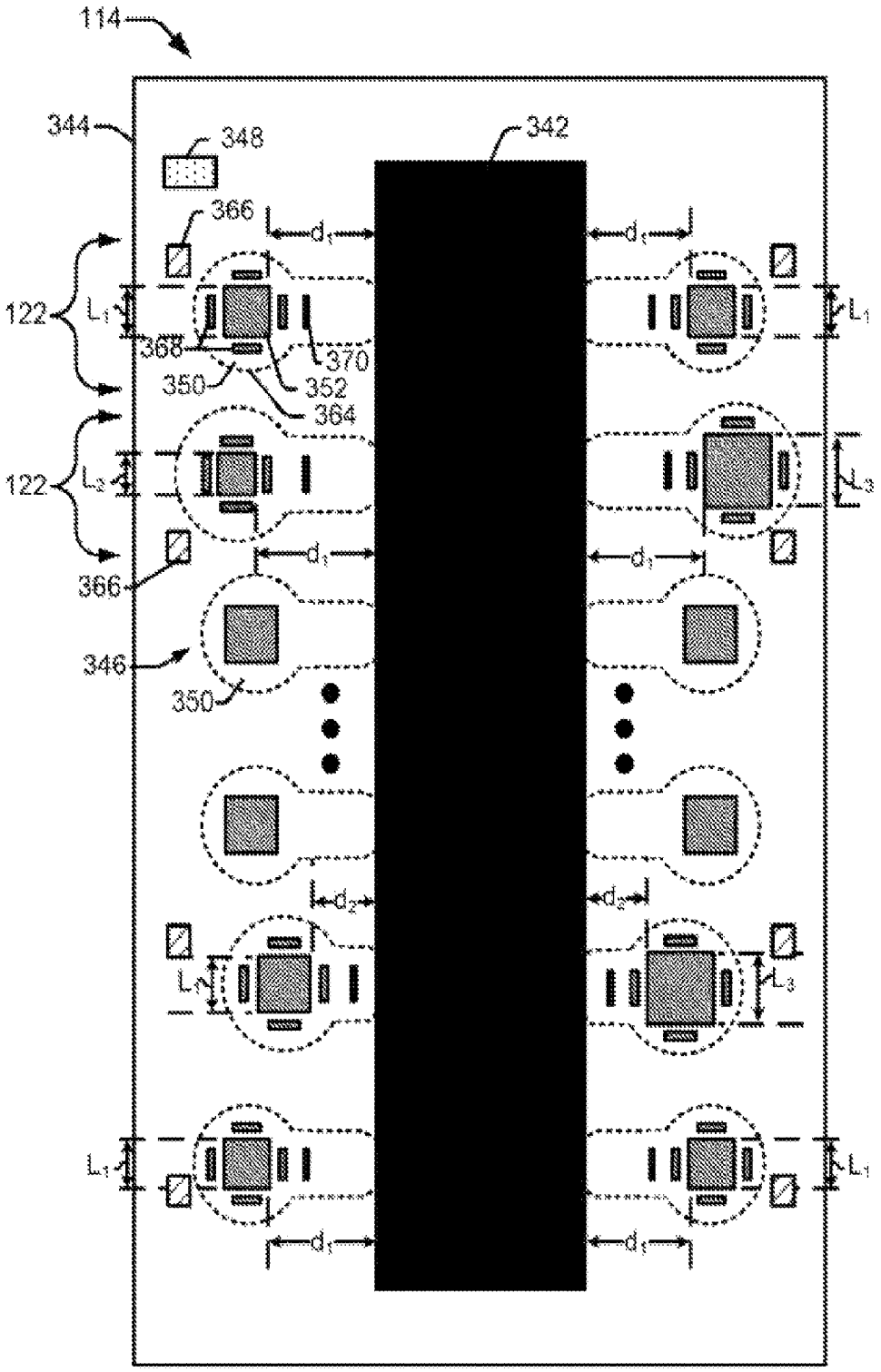
FIG. 5 is a bottom view of another printhead including a fluid feed slot and PILS.

FIGS. 3-5 shows bottom views of various example implementations of TIJ printheads 114. As shown in FIG. 3, the printhead 114 may include a fluid slot 342 formed in a silicon die substrate 344, in accordance with various implementations. Various components integrated on the printhead die substrate 344 may include fluid drop generators 346, a plurality of printhead-integrated ink level sensors (PILS) 122 and related circuitry, and a shift register 348 coupled to each PILS 122 to enable multiplexed selection of individual PILS 122, as discussed in greater detail below. Although the printhead 114 is shown with a single fluid slot 342, the principles discussed herein are not limited in their application to a printhead with just one slot 342. Rather, other printhead configurations may also be possible, such as printheads with two or more fluid feed slots. In the TIJ printhead 114, the die/substrate 344 underlies a chamber layer having fluid chambers 350 and a nozzle layer having nozzles 116 formed therein, as discussed below with respect to FIG. 6. For the purpose of illustration, however, the chamber layer and nozzle layer in FIGS. 3-5 are assumed to be transparent in order to show the underlying substrate 344. The chambers 350, therefore, are illustrated using dashed lines in FIGS. 3-5.

The fluid feed slot 342 may be an elongated slot formed in the substrate 344. The fluid feed slot 342 may be in fluid communication with a fluid supply (not shown), such as a fluid reservoir 120 shown in FIG. 1. The fluid feed slot 342 may include multiple fluid drop generators 346 arranged along both sides of the fluid feed slot 342, as well as a plurality of PILS 122. In various implementations, the PILS 122 may be located generally toward the fluid feed slot 342 ends, as shown, along either side of the fluid feed slot 342. For example, in some implementations, a fluid ejection device may include four PILS 122 per fluid feed slot 342, each PILS 122 located generally near one of four corners of the fluid feed slot 342, toward the ends of the fluid feed slot 342. In other implementations, a fluid ejection device may include more than four PILS 122 per fluid feed slot 342, at least one PILS 122 located generally near one of four corners of the fluid feed slot 342, toward the ends of the fluid feed slot 342. As shown, for example, the print head 114 includes eight PILS 122 per fluid feed slot 342, with two PILS 122 located generally near one of the four corners of the fluid feed slot 342, toward the ends of the fluid feed slot 342. Various other configurations may be possible within the scope of the present disclosure.

While each PILS 122 is typically located near an end-corner of the fluid feed slot 342, as shown in FIGS. 3-5, this is not intended as a limitation on other possible locations of a PILS 122. Thus, PILS 122 can be located around the fluid feed slot 342 in other areas such as midway between the ends of the fluid feed slot 342. In some implementations, a PILS 122 may be located on one end of the fluid feed slot 342 such that it extends outward from the end of the fluid feed slot 342 rather than from the side edge of the fluid feed slot 342. As shown in FIG. 2, however, for PILS 122 located generally near end-corners of a fluid feed slot 342, it may be advantageous to maintain a certain safe distance between the plate sense capacitor (Csense) 352 of the PILS 122 (e.g., between one edge of the plate sense capacitor 352) and the end of the fluid feed slot 342. Maintaining a minimum safe distance may help to ensure that there is no signal degradation from the sense capacitor (Csense) 352 due to the potential of reduced fluid (low rate that may be encountered at the ends of the fluid feed slots 342. In some implementations, a minimum safe distance to maintain between the plate sense capacitor (Csense) 352 and the end of the fluid feed slot 342 may be at least 40 μm, and in some implementations, at least about 50 μm.

Each of the PILS 122 may be in fluid communication with the fluid feed slot 312 and may be configured to sense an ink level of its respective fluid chamber 350, as described more fully herein in various implementations, the printhead 114 may include a plurality of PILS 122 to detect differing ink level states of the fluid ejection device, for example, a fluid election device may include one or more PILS 122 similarly configured to detect an empty ink level of their respective chambers 350 (e.g., when the PILS 122 detects that its respective chamber 350 is empty of fluid), which may indicate a particular ink level slate of the fluid ejection device. For example, the detection of an empty ink level of a respective chamber 350 by a PILS 122 may indicate the fluid ejection device is in an empty ink level state or non-empty ink level state (e.g., a near-empty ink level state). In some implementations, one or more PILS 122 may detect an empty ink level of their respective chambers 350 when the fluid ejection device is at a first ink level state, while other one or more PILS 122 may detect an empty ink level of their respective chambers when the fluid ejection device is at a second ink level state, different than the first ink level state, In various ones of these implementations, a plurality of ink level states of the fluid election device may be determined based on the different states of the differently configured PILS 122, which may allow more defined ink level sensing.

As shown in FIG. 3, for example, all of the PILS 122 are located a same distance, $d_1$ from the fluid feed slot 342 but differ with respect to the lengths of their capacitor plates 352. The four PILS 122 located closest to the ends of the fluid feed slot 342 are similarly configured with the same capacitor plate lengths, $L_1$, while the other four PILS 122 are similarly configured with the capacitor plate lengths, $L_2$, smaller than $L_1$. In this configuration, the PILS 122 with the shorter capacitor plates 352 (e.g., with capacitor plate length $L_2$) may sense an empty state sooner than the PILS 122 with the longer capacitor plates (with capacitor plate length $L_1$). In other words, for a given ink level state of the fluid ejection device, the PILS 122 may sense different ink levels in their respective chambers 350 (two different ink levels in this example). Although the sensed ink level of an implementation of a printhead 114 having PILS 122 with substantially identical configurations may nevertheless be indicative of the ink level state of the printhead 114, implementing differing configurations of PILS 122 may allow for a more nuanced ink level state sensing, with more defined ink level states. For example, at a time t1, a first PILS may detect an empty ink level of its respective chamber, while a second PILS may detect a non-empty ink level of its respective chamber, and this combination of states may indicate a particular ink level state of the fluid ejection device (e.g., a first remaining percentage of ink). In this same example, at a time t2, both the first PILS and live second PILS may detect an empty ink level of their respective chambers, and this combination of suites may indicate another ink level state of the fluid ejection device (e.g., a second remaining percentage of ink, less than the first remaining percentage of ink). Various other combinations of readings, using the same number of more PILS, may be possible within the scope of the present disclosure. In many implementations, a printhead 114 with differing configurations of PILS 122 may be provide more accurate ink level state sensing as compared to implementations using identical configurations of PILS 122.

In some implementations, in addition to or instead of implementing the printhead 114 with different capacitor plate lengths, the PILS 122 may be located at different distances from the fluid feed slot 342 to provide the improved ink level state sensing described herein. As shown in FIG. 4, for example, the printhead 114 may include PILS 122 having capacitor plates 352 with the same capacitor plate lengths. $L_1$, but with different distances, $d_1/d_2$ from the fluid feed slot 342. In yet another example shown in FIG. 5, the printhead 114 may include PILS 122 having capacitor plates 352 with different capacitor plate lengths, $L_1/L_2/L_3$ and with different distances, $d_1/d_2$, from the fluid feed slot 342. Various other configurations may be possible within the scope of the present disclosure.

Figure 6:
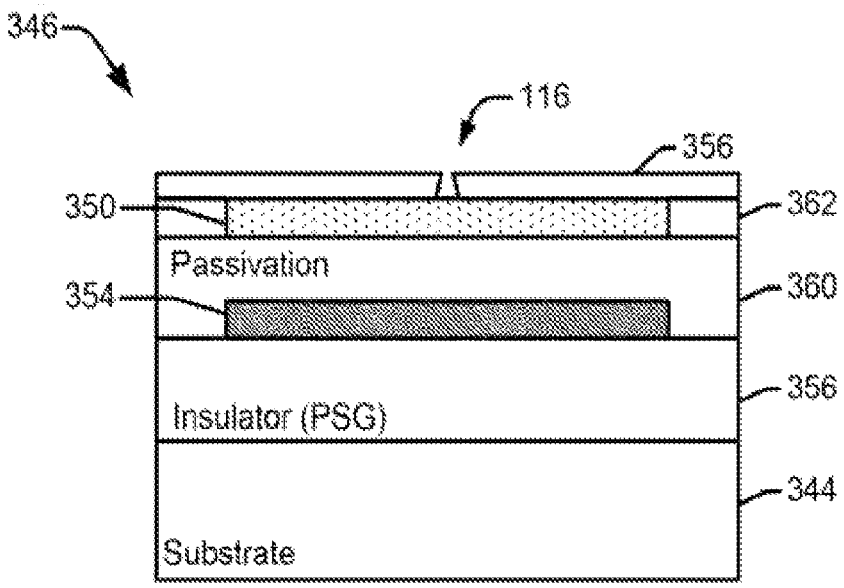
FIG. 6 is a cross-sectional view of an example fluid drop generator.

Turning now to FIG. 6, with continued reference to FIGS. 1-5, illustrated is a cross-sectional view of an example fluid drop generator 346, in accordance with various implementations. As shown, the drop generator 346 may include a nozzle 116, a fluid chamber 350, and a firing element 354 disposed in the fluid chamber 350. The nozzles 116 may be formed in a nozzle layer 356 and may be generally arranged to form nozzle columns along the sides of the fluid feed slot 342. The firing element 354 may be a thermal resistor formed of a dual metal layer metal plate (e.g., tantalum-aluminum, TaAl and aluminum copper, AlCu, or tungsten silicon nitride, WSiN, and AlCu) on an insulating layer 356 (e.g., polysilicon glass, PSG) on a top surface of the silicon substrate 344. A passivation layer 360 over the firing element 354 may protect the firing element 354 from ink in the chamber 350 and may act as a mechanical passivation or protective cavitation barrier structure to absorb the shock of collapsing vapor bubbles. A chamber layer 362 may have walls and chambers 350 that separate the substrate 358 from the nozzle layer 356.

During operation, a fluid drop may be ejected from a chamber 350 through a corresponding nozzle 116 and the chamber 150 may then be refilled with fluid circulating from fluid feed slot 352. More specifically, an electric current may be passed through a resistor firing element 354 resulting in rapid healing of the element. A thin layer of fluid adjacent to the passivation layer 360 over the firing element 354 may be superheated and vaporizes, creating a vapor bubble in the corresponding firing chamber 350. The rapidly expanding vapor bubble may be a fluid drop out of the corresponding nozzle 116. When the heating element cools, the vapor bubble may quickly collapse, drawing more fluid from fluid feed slot 342 into the firing chamber 350 in preparation for ejecting another drop from the nozzle 116.

Figure 7:
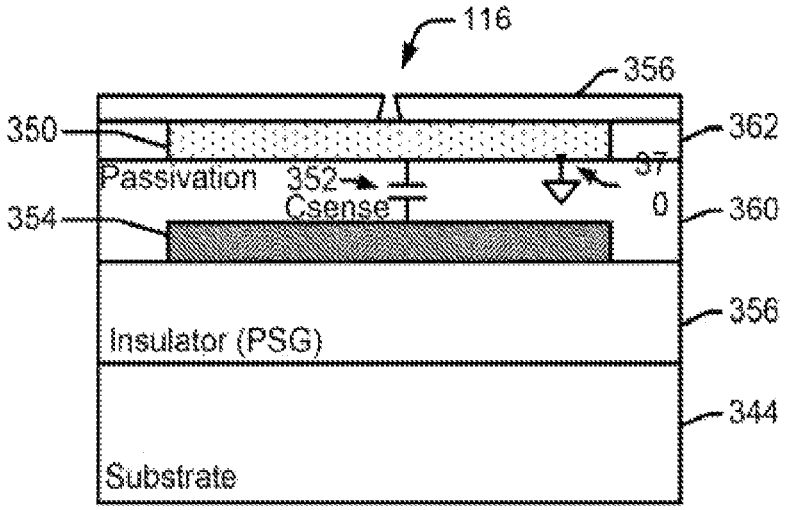
FIG. 7 is a cross-sectional view of an example sense structure.

FIG. 7, with continued reference to FIGS. 1-6, shows a cross-sectional view of a portion of an example PILS 122, in accordance with various implementations. As shown in FIGS. 3-5, the PILS 122 generally may include a sense structure 364, sensor circuitry 366, und a clearing resistor circuit 368, integrated on the printhead 114. The sense structure 364 of the PILS 122 may be generally configured in the same manner as a drop generator 356, but includes a clearing resistor circuit 368 and a ground 370 to provide ground for the sense capacitor (Csense) 352 through the substance (e.g., ink, ink-air, air) in the PILS chamber 350. Therefore, like a typical drop generator 356, the sense structure 364 includes a nozzle 116, a fluid chamber 350, a conductive element such as a metal plate element 354 disposed within the fluid/ink chamber 350, a passivation layer 360 over the plate element 354, and an insulating layer 356 (e.g., polysilicon glass, PSG) on a top surface of the silicon substrate 344. However, as discussed above with reference to FIG. 1, a PILS 122 may additionally employ a current source 130 and analog to digital converter (ADC) 132 from a printer ASIC 126 that is not integrated onto the printhead 114. Instead, the printer ASIC 126 may be located, for example, on the printer carriage or electronic controller 110 of the printer system 100.

Within the sense structure 364, a sense capacitor (Csense) 352 may be formed by the metal plate element 354, the passivation layer 660, and the substance or contents of the chamber 350. The sensor circuitry 366 may incorporate sense capacitor (Csense) 352 from within the same structure 352. The value of the sense capacitor 352 may change as the substance within the chamber 350 changes. The substance in the chamber 350 can be all ink, ink and air, or just air. Thus, the value of the sense capacitor 352 changes with the level of ink in the chamber 350. When ink is present in the chamber 350, the sense capacitor 352 has good conductance to ground 370 so the capacitance value is highest (e.g. 100%). However, when there is no ink in the chamber 350 (e.g. air only) the capacitance of sense capacitor 352 drops to a very small value, which is ideally close to zero. When the chamber contains ink and air, the capacitance value of sense capacitor 352 may be somewhere between zero and 100%. Using the changing value of the sense capacitor 352, the ink level sensor circuitry 366 may enable a determination of the ink level. In general, the ink level in the chamber 350 may be indicative of the ink level state of ink in reservoir 120 of printer system 100.

In some implementations, a clearing resistor circuit 368 may be used to purge ink and or ink residue from the chamber 350 of the PILS sense structure 364 prior to measuring the ink level with sensor circuit 366. Thereafter, to the extent that ink is present in the reservoir 120, it may flow back into the chamber 10 enable an accurate ink level measurement. As shown in FIGS. 3-5, in various implementations a clearing resistor circuit 368 may include four clearing resistors surrounding the metal plate element 354 of sense capacitor (Csense) 352. Each clearing resistor 368 may be adjacent to one of the four sides of the metal plate element 354 of the sense capacitor (Csense) 352. The clearing resistors 368 may comprise thermal resistors formed, for example, of tantalum-aluminum or TaAl and aluminum copper or AlCu, such as discussed above, that may provide rapid heating of the ink to create vapor bubbles that force ink out of the PILS chamber 350. The clearing resistor circuit 368 may purge ink from the chamber 350 and remove residual ink from the metal plate element 354 of sense capacitor (Csense) 352. Ink flowing back into the PILS chamber 350 from the fluid feed slot 342 then may enable a more accurate sense of the ink level through sense capacitor (Csense) 352. In some implementations, a delay may be provided by controller 110 after the activation of the clearing resistor circuit 368 to provide time for ink from fluid feed slot 342 to flow back into the PILS chamber 350 prior to sensing the ink level in the PILS chamber 350. While the clearing resistor circuit 368 having four resistors surrounding the sense capacitor (Csense) 352 may have an advantage of providing for a significant clearing of ink from the sense capacitor 352 and PILS chamber 350, other clearing resistor configurations are also contemplated that may provide clearing of ink to lesser or greater degrees. For example, a clearing resistor circuit 368 may be configured with an in-line resistor configuration in which the clearing resistors are in-line with one another, adjacent the back edge of the metal plate element 354 of sense capacitor (Csense) 352 at the back side of the PILS chamber 350 away from the fluid feed slot 342.

Figure 8:
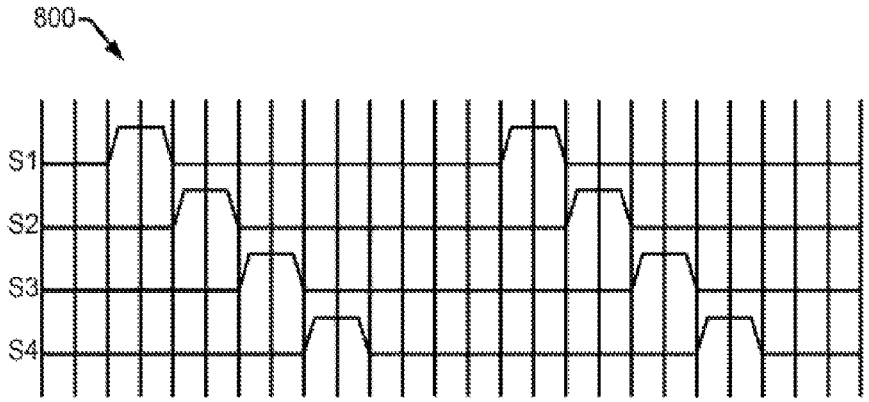
FIG. 8 is a timing diagram of non-overlapping clock signals used to drive a printhead.

FIG. 8 is an example of a partial timing diagram 800 having non-overlapping clock signals (S1-S4) with synchronized data and fire signals that may be used to drive a printhead 114, in accordance with various implementations. The clock signals in the timing diagram 800 may also be used to drive the operation of the PILS ink level sensor circuit 366 and shift register 348 as discussed below.

Figure 9:
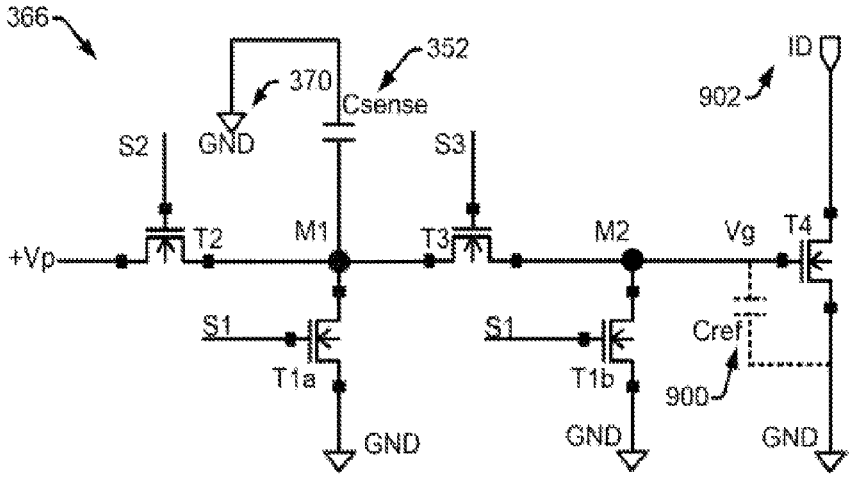
FIG. 9 is an example ink level sensor circuit.

FIG. 9 is an example ink level sensor circuit 366 of a PILS 122, in accordance with various implementations. In general, the sensor circuit 366 may employ a charge sharing mechanism to determine different levels of ink in a PILS chamber 350. The sensor circuit 366 may include two first transistors, T1 (T1*a*, T1*b*), configured as switches. Referring to FIGS. 8 and 9, during operation of the sensor circuit 366, in a first step a clock pulse S1 is used to close the transistor switches T1*a* and T1*b*. coupling memory nodes M1 and M2 to ground and discharging the sense capacitor 352 and the reference capacitor 900. The reference capacitor 900 may be the capacitance between node M2 and ground. In this example, the reference capacitor 900 may be implemented as the inherent gate capacitance of evaluation transistor T4, and it is therefore illustrated using dashed lines. The reference capacitor 900 may additionally include associated parasitic capacitance such as gate-source overlap capacitance, but the T4 gate capacitance is the dominant capacitance in reference capacitor 900. Using the gate capacitance of transistor T4 as a reference capacitor 900 reduces the number of components in sensor circuit 366 by avoiding a specific reference capacitor fabricated between node M2 and ground. In other implementations, however, it may be beneficial to adjust the value of reference capacitor 900 through the inclusion of a specific capacitor fabricated from M2 to ground (e.g., in addition to the inherent rate capacitance of T4).

In a second step, the S1 clock pulse terminates, opening the T1*a* and T1*b* switches. Directly after the T1 switches open, an S2 clock pulse is used to close transistor switch T2. Closing T2 couples node M1 to a pre-charge voltage, Vp (e.g., on the order of +15 volts), and a charge Q1 is placed across sense capacitor 366 according to the equation. Q1=(Csense)*(Vp). At this time the M2 node remains at zero voltage potential since the S3 clock pulse is off. In a third step, the S2 clock pulse terminates, opening the T2 transistor switch. Directly after the T2 switch opens, the S3 clock pulse closes transistor switch T3 coupling nodes M1 and M2 to one another and sharing the charge Q1 between sense capacitor 352 and reference capacitor 900. The shared charge Q1 between sense capacitor 212 and reference capacitor 900 results in a reference voltage, Vg, at node M2 which is also at the gate of evaluation transistor T4, according to the following equation:

$$Vg = \left(\frac{Csense}{Csense + Cref}\right)Vp$$

Vg remains at M2 until another cycle begins with a clock pulse S1 grounding memory nodes M1 and M2. Vg at M2 turns on evaluation transistor T4, winch enables a measurement at ID 902 (the drain of transistor T4). In this implementation, it is presumed that transistor T4 is biased in the linear mode of operation, where T4 acts as a resistor whose value is proportional to the gate voltage Vg (e.g., reference voltage). The T4 resistance from drain to source (coupled to ground) is determined by forcing a small current at ID 902 (e.g., a current on the order of 1 milliamp). With additional reference to FIG. 1, ID 902 is coupled to a current source, such as current source 130 in printer ASIC 126. Upon applying the current source at ID, the voltage ($V_{ID}$) is measured at ID 902 by the ASIC 126. Firmware, such as Rsense module 128 executing on controller 110 or ASIC 120 can convert $V_{ID}$ to a resistance Rds from drain to source of the T4 transistor using the current at ID 902 and $V_{ID}$. The ADC 132 in printer ASIC 126 subsequently determines a corresponding digital value for the resistance Rds. The resistance Rds enables an inference as to the value of Vg based on the characteristics of transistor T4. Based on a value for Vg, a value of Csense can be found from the equation for Vg shown above. A level of ink can then be determined based on the value of Csense.

Once the resistance Rds is determined, there are various ways in which the level ink can be found. For example, the measured Rds value can be compared to a reference value for Rds, or a table of Rds values experimentally determined to be associated with specific ink levels. With no ink (e.g., a "dry" signal), or a very low ink level, the value of sense capacitor 352 is very low. This results in a very low Vg (on the order of 1.7 volts), and the evaluation transistor T4 is off or nearly off (e.g., T4 is in cut off or sub-threshold operation region). Therefore, the resistance Rds from ID to ground through T4 would be very high (e.g., with ID current of 1.2 mA, Rds is typically above 12 k ohm). Conversely, with a high ink level (e.g., a "wet" signal), the value of sense capacitor 352 is close to 100% of its value, resulting in a high value for Vg (on the order of 3.5 volts). Therefore, the resistance Rds is low. For example, with a high ink level Rds is below 1 k ohm, and is typically a few hundred ohms.

Figure 10:
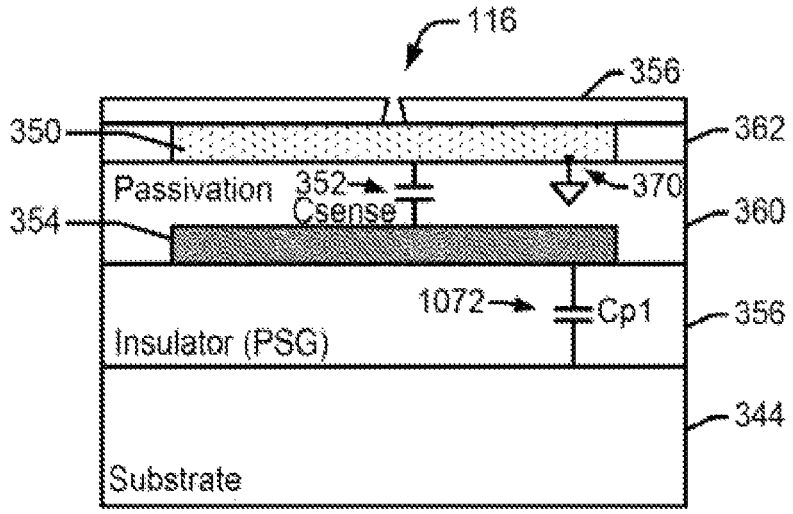
FIG. 10 is a cross-sectional view of an example sense structure with both a sense capacitor and an intrinsic parasitic capacitance.

FIG. 10 is a cross-sectional view of an example PILS sense structure 364 that illustrates both the sense capacitor 352 and an intrinsic parasitic capacitance Cp1 (1072) underneath the metal plate 354 that may form pad of sense capacitor 352, in accordance with various implementations. The intrinsic parasitic capacitance Cp1 1072 may be formed by the metal plate 354, the insulation layer 356, and substrate 344. As described herein, a PILS 122 may determine an ink level based on the capacitance value of sense capacitor 352. When a voltage (e.g., Vp) is applied to the metal plate 354, charging the sense capacitor 352, however, the Cp1 1072 capacitor also charges. Because of this, the parasitic capacitance Cp1 1072 may contribute on the order of 20% of the capacitance determined for sense capacitor 352. This percentage may vary depending on the thickness of the insulation layer 356 and the dielectric constant of the insulation material. The charge remaining in the parasitic capacitance Cp1 1072 in a "dry" state (e.g., where no ink is present), however, may be enough to turn on the evaluation transistor 14. The parasitic Cp1 1072, therefore, may dilute the dry wet signal.

Figure 11:
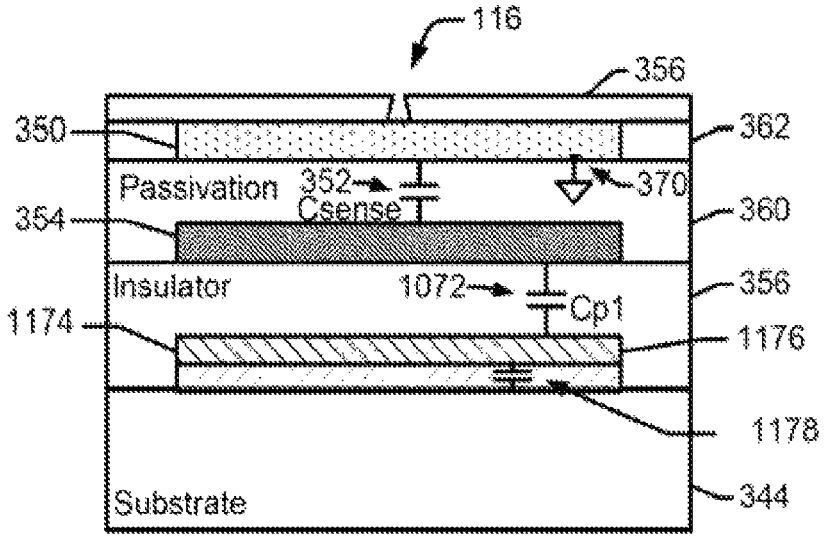
FIG. 11 is a cross-sectional view of an example sense structure that includes a parasitic elimination element.

FIG. 11 is a cross-sectional view of an example sense structure 364 that includes a parasitic elimination element 1174, in accordance with various implementations. The parasitic elimination element 1176 may comprise a conductive layer 1176 such as a polysilicon layer designed to eliminate the impact of the parasitic capacitance Cp1 1072. In this configuration, when a voltage (e.g., Vp) is applied to the metal plate 354, it may also be applied to the conductive layer 1174. In various implementations, this may prevent a charge from developing on the Cp1 1072 so that Cp1 is effectively removed isolated from the determination of the sense capacitor 212 capacitance. Cp2, element 1178, may be the intrinsic capacitance from the parasitic diminution element 1174. Cp2 1178 may slow the charging speed of the parasitic elimination element 1174 but may have no impact on the removal isolation of Cp1 1072 because there is sufficient charge time provided for element 1174.

Figure 12:
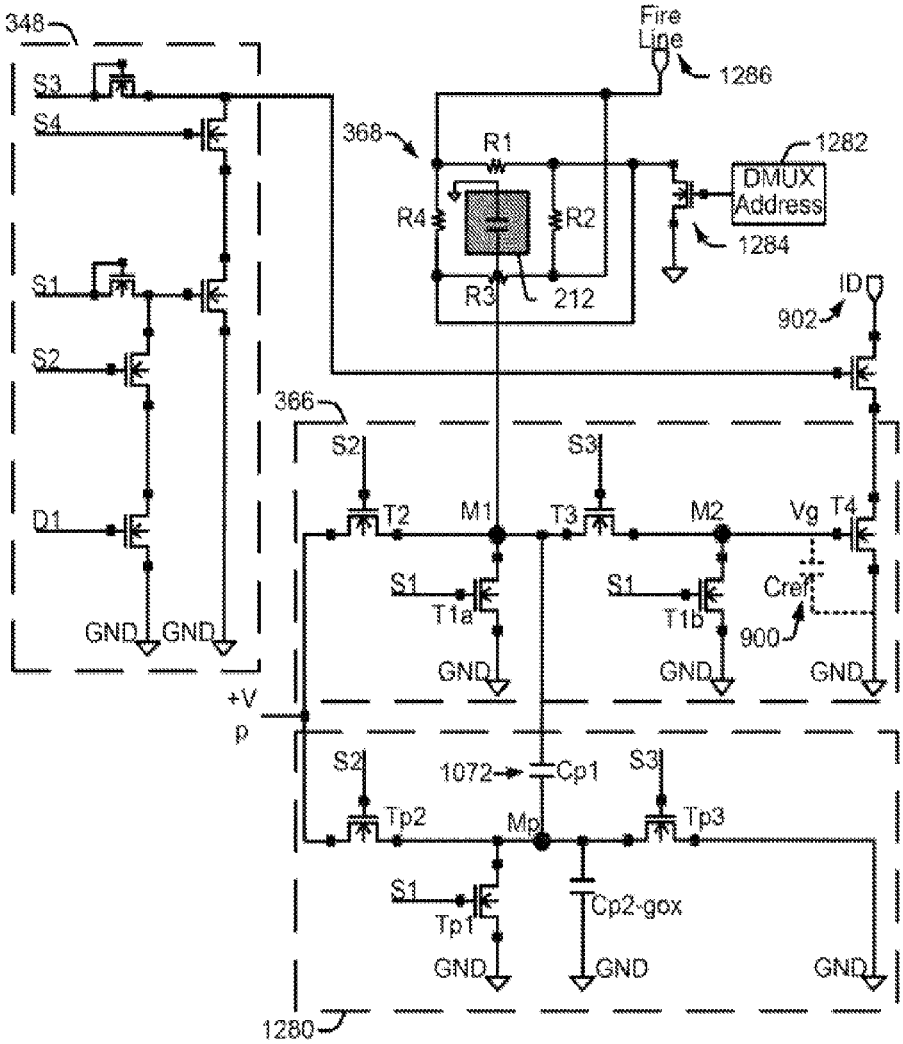
FIG. 12 is an example PILS ink level sensor circuit including a parasitic elimination circuit, a clear log resistor circuit, and shift register.

FIG. 12 is an example PILS ink level sensor circuit 366 with a parasitic elimination circuit 1280, clearing resistor circuit 368, and shift register 348, in accordance with various implementations. As noted herein, clearing resistor circuit 368 may be activated to purge ink and or ink residue out of a PILS chamber 350 prior to measuring the sensor circuit 366 at ID 902. The clearing resistors R1, R2, R3, and R4, may operate like typical TIJ firing resistors. Thus, they may be addressed by dynamic memory multiplexing (DMUX) 1282 and driven by a power FET 1284 connected to a fire line 1286. The controller 110 (FIG. 1) may control activation of clearing resistor circuit 368 through the fire line 1286 and DMUX 1282, by execution of particular firing instructions from clearing module 134, for example.

Figure 13:
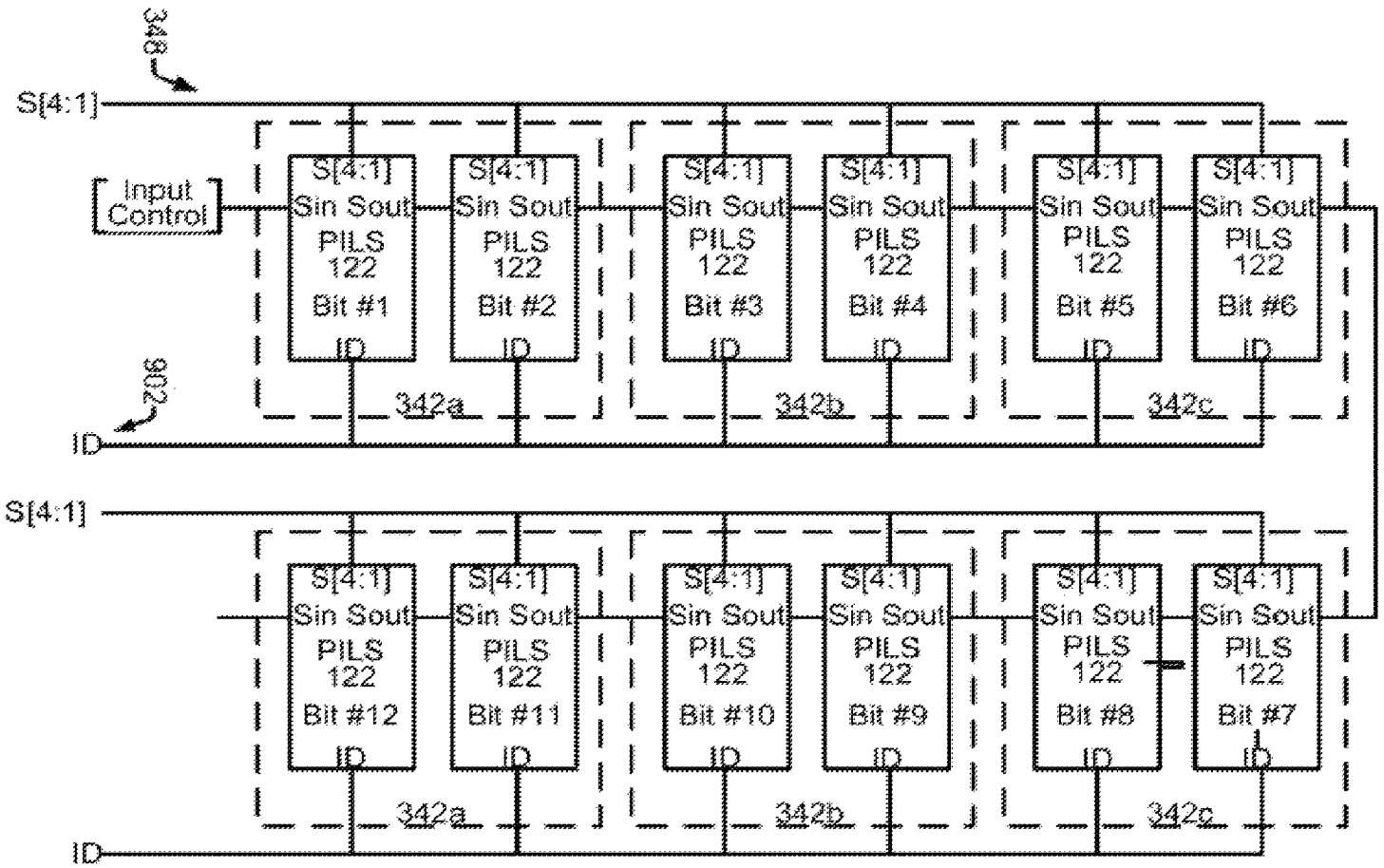
FIG. 13 is an example of a shift register that addresses a plurality of PILS signals.

Typically, multiple sensor circuits 366 from multiple PILS 122 may be connected to a common ID 902 line. For example, a color printhead die/substrate 344 with several fluid feed slots 342 may have twelve or more PILS 122 (e.g., eight PILS 122 per slot 342, as in FIGS. 3-6). The shift register 348 may enable multiplexing the outputs of multiple PILS sensor circuits 366 onto the common ID 902 line. A PILS select module 136 executing on the controller 110 may control the shift register 348 to provide a sequenced output, or other ordered output of the multiple PILS sensor circuits 366 onto common ID 902 line. FIG. 13 shows another example of a shift register 348 that addresses multiple PILS 122 signals, in accordance with various implementations. In FIG. 13, a shift register 348 comprises a PILS block selective circuit to address multiple PILS signals from twelve PILS 122. There are three slots 342 (342*a*, 342*b*, 342*c*) on a color die, with four PILS 122 for each slot 342. For implementations including more than twelve PILS 122 (e.g., implementations including eight PILS 122 per slot 342), the shift register 348 may be similarly configured for addressing the additional PILS 122. Addressing the multiple PILS signals through shift register 348 may increase the accuracy of ink level measurements by checking various locations on the die. In general, by employing shirt register 348, the measurement results from similarly configured ones of the plurality of PILS 122 (e.g., PILS 122 with the same capacitor plate length and distance from the fluid feed slot) may be compared, averaged, or otherwise mathematically manipulated by ASIC 126, for example, to provide greater accuracy in determining ink levels of the respective chambers and ink level states of the fluid ejection device.

Figure 14:
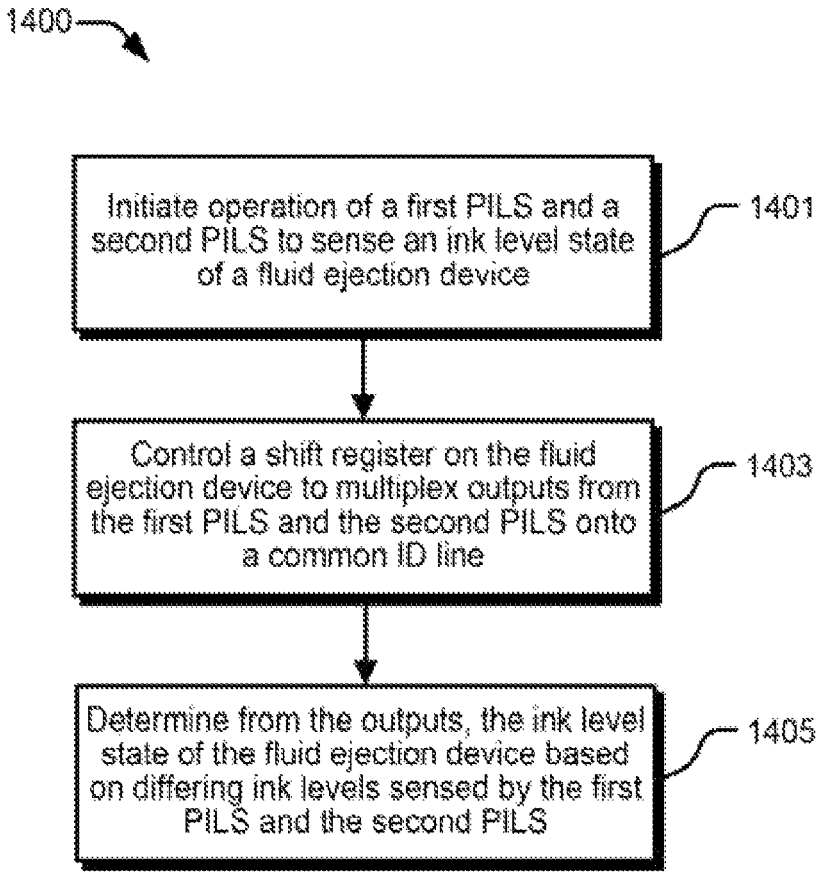
FIG. 14 is a flowchart of example method related to sensing an ink level state of a fluid election device using a plurality of PILS.

FIG. 14 is a flowchart of an example method 1400 related to sensing an ink level state of a fluid ejection device with a printhead-integrated ink level sensor (PILS), in accordance with various implementations described herein. The method 1400 may be associated with the various implementations described herein with reference to FIGS. 1-13, and details of the operations shown in the method 1400 may be found in the related discussion of such implementations. The operations of the method 1400 may be embodied as programming instructions stored on a computer/processor-readable medium, such as memory 140 described herein with reference to FIG. 1. In an implementation, the operations of the method 1400 may be achieved by the reading and execution of such programming instructions by a processor, such as processor 138 described herein with reference to FIG. 1. It is noted that various operations discussed and or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

The method 1400 may begin or proceed with initiating operation of a plurality of PILS (e.g., a first PILS and a second PILS) to sense an ink level state of a fluid ejection device at a corresponding plurality of areas of a printhead die of the fluid ejection device (block 1401). The plurality of PILS may be located around one or multiple fluid feed slots of the printhead die, and the PILS may be configured to detect an empty ink level of a respective chamber when the fluid ejection device is at varying ink level states. For example, a first PILS may sense an ink level of a first chamber in fluid communication with the fluid feed slot, and may detect an empty ink level of the first chamber when the fluid ejection device is at a first ink level state. A second PILS may sense an ink level of a second chamber in fluid communication with the fluid feed slot, and may detect an empty ink level of the second chamber when the fluid ejection device is at a second ink level state, different than the first ink level state.

In various implementations, the operation of a PILS may comprise a number of operations, including, for example, activating a clearing resistor circuit to purge ink from a sense chamber. In some of these implementations, the method 1400 may include providing a delay after activating the clearing resistor circuit to enable ink from a fluid feed slot to flow back into the sense chamber. After purging ink from the sense chamber, the method 1400 may proceed with placing a charge on a sense capacitor at a memory node M1 (see. e.g., FIGS. 9 and 12 and accompanying description) and coupling M1 to a second memory node M2 to share the charge between the sense capacitor and a reference capacitor. The shared charge may cause a reference voltage. Vg, at M1, M2, and at a transistor gate. A resistance may then be determined across the transistor drain to source, and then compared to a reference value to determine an ink level state of the fluid ejection device.

In various implementations, operation of a PILS may also include removing, or eliminating the presence of an intrinsic parasitic capacitance in the PILS (see, e.g., FIGS. 10-12 and accompanying description). This may be achieved by applying a voltage Vp to M1 to place the charge on the sense capacitor, and then to simultaneously apply Vp to a node Mp to prevent the parasitic capacitance change from developing between M1 and Mp.

The method 1400 may proceed to block 1403 with controlling a shift register on the fluid ejection device to multiplex outputs from the plurality of PILS onto a common ID line. At block 1405, the ink levels of the PILS, and ink level state of the fluid ejection device, may then be determined by using the outputs from the plurality of PILS. This may be achieved, for example, by averaging the multiple outputs from similarly configured ones of the plurality of PILS (e.g., PILS with the same capacitor plate length and distance from the fluid feed slot) in an algorithm performed by ASIC 126 or controller 110. For example, in some implementations, the method 1400 may comprise determining a first ink level state when a first PILS senses a non-empty ink level of a first chamber in fluid communication with the fluid feed slot and a second PILS senses a non-empty ink level of a second chamber in fluid communication with the fluid feed slot, determining a second ink level state when the first PILS senses an empty ink level of the first chamber and the second PILS senses a non-empty ink level of the second chamber, and a third ink level state when the first PILS senses an empty ink level of the first chamber and the second PILS senses an empty ink level of the second chamber.

Although certain implementations have been illustrated and described herein, it will be appreciated by those of ordinary skill in the art that a wide variety of alternate and/or equivalent implementations calculated to achieve the same purposes may be substituted for the implementations shown and described without departing from the scope of this disclosure. Those with skill in the art will readily appreciate that implementations may be implemented in a wide variety of ways. This application is intended to cover any adaptations or variations of the implementations discussed herein. It is manifestly intended, therefore, that implementations be limited only by the claims and the equivalents thereof.

What is claimed is:

1. A fluid ejection device comprising:

a fluid feed slot formed in a printhead die;

a first printhead-integrated ink level sensor (PILS) to sense an ink level of a first chamber in fluid communication with the fluid feed slot, the first PILS to detect an empty ink level of the first chamber when the fluid ejection device is at a first ink level state; and a second PILS to sense an ink level of a second chamber in fluid communication with the fluid feed slot, the second PILS to detect an empty ink level of the second chamber when the fluid ejection device is at a second ink level state, different than the first ink level state.

2. The fluid ejection device of claim 1, wherein the first PILS includes a first sense capacitor plate having a first plate length, and wherein the second PILS includes a second sense capacitor plate having a second plate length different than the first plate length.

3. The fluid ejection device of claim 2, wherein the first sense capacitor plate and the second sense capacitor plate are at a same distance from an edge of the fluid feed slot.

4. The fluid ejection device of claim 2, wherein the first sense capacitor plate is at a first distance from an edge of the fluid feed slot, and wherein the second sense capacitor plate is at a second distance, different than the first distance, from the edge of the fluid feed slot.

5. The fluid ejection device of claim 1, wherein the first PILS includes a first sense capacitor plate at a first distance from an edge of the fluid feed slot, and wherein the second PILS includes a second sense capacitor plate at a second distance, different than the first distance, from the edge of the fluid feed slot.

6. The fluid ejection device of claim 5, wherein the first sense capacitor plate and the second sense capacitor plate have a same plate length.

7. The fluid election device of claim 1, further comprising a shift register to select between the first PILS and the second PILS for output onto a common ID line.

8. The fluid ejection device of claim 1, further comprising a third PILS and a fourth PILS, wherein the first, second, third, and fourth PILS are located around the fluid feed slot, each of the first, second, third, and fourth PILS located near a different corner of the fluid feed slot.

9. The fluid ejection device of claim 1, wherein the first ink level state is an empty ink level state and the second ink level state is a non-empty ink level state.

10. The fluid ejection device of claim 1, wherein each of the first PILS and the second PILS comprises:

a sense capacitor whose capacitance changes with the ink level in the chamber;

a switch T2 to apply a voltage Vp to the sense capacitor, placing a charge on the sense capacitor;

a switch T3 to share the charge between the sense capacitor and a reference capacitor, resulting in a reference voltage Vg; and an evaluation transistor configured to provide a drain to source resistance in proportion to the reference voltage.

11. A fluid election device comprising:

a plurality of printhead-integrated ink level sensors (PILS) including a first PILS to sense an ink level of a first chamber in fluid communication with a fluid feed slot, the first PILS to detect an empty ink level of the first chamber when the fluid ejection device is at a first ink level state, and a second PILS to sense an ink level of a second chamber in fluid communication with the fluid feed slot, the second PILS to detect an empty ink level of the second chamber when the fluid ejection device is at a second ink level state, different than the first ink level state;

a shift register to select between the first PILS and the second PILS for output onto a common ID line; and a controller to control the shift register to select between the first PILS and the second PILS for output onto a common ID line.

12. The fluid ejection device of claim 11, further comprising a clearing resistor circuit disposed within the first chamber to clear the chamber of ink, and wherein the controller is to control activation of the clearing resistor circuit.

13. An article of manufacture comprising:

a processor-readable non-transition storage medium; and a plurality of programming instructions stored in the storage medium to cause a fluid ejection device, in response to execution of the programming instructions by the processor, to perform a plurality of operations including:

initiating operation of a first printhead-integrated ink level sensor (PILS) of a first chamber in fluid communication with a fluid feed slot of the fluid ejection device and a second PILS of a second chamber in fluid communication with the fluid feed slot to sense an ink level state of the fluid ejection device;

controlling a shift register on the fluid ejection device to multiplex outputs from the first PILS and the second PILS onto a common ID line; and determining, from the outputs, the ink level state of the fluid ejection device based on differing ink levels sensed by the first PILS and the second PILS.

14. The article of manufacture of claim 13, wherein said determining comprises determining the level state of the fluid ejection device based on a non-empty ink level sensed by the first PILS and an empty ink level sensed by the second PILS.

15. The article of manufacture of claim 13, wherein said determining comprises determining a first ink level state when the first PILS senses a non-empty ink level of the first chamber and the second PILS senses a non-empty ink level of the second chamber, a second ink level state when the first PILS senses an empty ink level of the first chamber and the second PILS senses a non-empty ink level of the second chamber, and a third ink level state when the first PILS senses an empty ink level of the first chamber and the second PILS senses an empty ink level of the second chamber.

* * * * *